United States Patent [19]

Sung et al.

[11] 4,321,060

[45] Mar. 23, 1982

[54] NOVEL PROCESS AND PRODUCT

[75] Inventors: Rodney L. Sung, Fishkill; George J. Sidote, Hopewell Junction, both of N.Y.

[73] Assignee: Texaco Inc., White Plains, N.Y.

[21] Appl. No.: 206,812

[22] Filed: Nov. 14, 1980

[51] Int. Cl.[3] ..... C10L 1/02

[52] U.S. Cl. ..... 44/53; 252/392; 252/394

[58] Field of Search ..... 44/53, 56; 252/392, 252/394; 422/7

[56] References Cited

U.S. PATENT DOCUMENTS

| | | | |
|---|---|---|---|
| 2,726,942 | 12/1955 | Arkis et al. | 44/56 |
| 3,404,165 | 10/1968 | Budde et al. | 252/392 |
| 4,192,844 | 3/1980 | Trace et al. | 252/392 |

*Primary Examiner*—Winston A. Douglas
*Assistant Examiner*—Y. Harris-Smith
*Attorney, Agent, or Firm*—Carl G. Ries; Robert A. Kulason; Carl G. Seutter

[57] ABSTRACT

Alcohols may be inhibited against corrosion by addition thereto of an ether amine $(R\text{-}O\text{-}R'')_a\text{-}NH_{3-a}$ typically $C_{13}H_{27}\text{-}0\text{-}(CH_2)_3\text{-}NH_2$.

22 Claims, No Drawings

NOVEL PROCESS AND PRODUCT

FIELD OF THE INVENTION

This invention relates to alcohol products particularly characterized by decreased ability to corrode metal surfaces with which they come into contact.

BACKGROUND OF THE INVENTION

As is well known to those skilled in the art, alcohols such as ethanol may corrode metal surfaces with which they come into contact. This is particularly true of crude or commercially available ethanols which undesirably contain acidic components commonly acetic acid. In the case of fermentation alcohols, acetic acid may be present in amount of 0.003 w %–0.005 w % of the alcohol; and this may be responsible for the fact that the alcohol causes serious corrosion problems.

It is an object of this invention to provide a novel process for decreasing the corrosion of alcohol compositions. Other objects will be apparent to those skilled in the art.

STATEMENT OF THE INVENTION

In accordance with certain of its aspects, the novel composition of this invention may comprise (i) a water-soluble alcohol preferably selected from the group consisting of ethanol and methanol; and (ii) an effective anti-corrosion inhibiting amount of as corrosion-inhibiting agent an amine having the formula $(R\text{-}O\text{-}R'')_a\text{-}NH_{3-a}$ wherein R contains 1–30 carbon atoms and is selected from the group consisting of alkyl, alkenyl, alkaryl, aralkyl, cycloalkyl, and aryl groups and R'' is a divalent hydrocarbon group containing 1–30 carbon atoms and is selected from the group consisting of alkyl, alkenyl, alkaryl, aralkyl, cycloalkyl, and aryl groups, and a is an integer 1–3.

DESCRIPTION OF THE INVENTION

The alcohol compositions which may be treated by the process of this invention may include $C_1$–$C_{12}$ alkanols such as water-soluble alkanols including $C_1$–$C_4$ alcohols. Preferably, the alcohols include methanol, ethanol, propanols, etc. The alcohols may include mixtures of alcohols with each other and/or with other compositions including ketones, esters, hydrocarbons, etc. The alcohol may be in the form of gasohol—a mixture commonly containing 80 v %–95 v %, say 90 v % gasoline and 5 v %–20 v %, say 10 v % alcohol. The alcohol may contain water, for example up to 10 w %–20 w %, typically 5 w %; but preferably it will be anhydrous. Anhydrous compositions commonly contain less than about 0.3 v % water, typically 0.001 v %–0.005 v %, say about 0.004 v % water. One preferred charge may be 100% anhydrous ethanol. Another preferred charge may be 100% anhydrous methanol.

Commercially available mixtures may be employed. Illustrative of one such commercially available mixture may be that having the following typical analysis:

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |

TABLE I-continued

| Component | Parts |
|---|---|
| n-propyl alcohol | 0.162 |
| ethyl acetate | 0.2 |

It is a particular feature of the process of this invention that it may be used to treat such compositions when they are to be used as fuels.

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute ethanol.

The fuels to be treated by the process of this invention may be substantially anhydrous i.e. they contain less than about 0.3 v % water; typically they may contain 0.001 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the alcohol a minor effective corrosion-inhibiting amount of, as a corrosion inhibiting additive, an amine having the formula $(R\text{-}O\text{-}R'')_a\text{-}NH_{3-a}$ wherein R contains 1–30 carbon atoms and is selected from the group consisting of alkyl, alkenyl, alkaryl, aralkyl, cycloalkyl, and aryl groups and R'' is a divalent hydrocarbon group containing 1–30 carbon atoms and is selected from the group consisting of alkyl, alkenyl, alkaryl, aralkyl, cycloalkyl, and aryl groups, and a is an integer 1–3.

In the above compound, R may be a hydrocarbon radical selected from the group consisting of alkyl, aralkyl, cycloalkyl, aryl, alkaryl, and alkenyl, including such radicals when inertly substituted. When R is alkyl, it may typically be methyl, ethyl, n-propyl, iso-propyl, n-butyl, i-butyl, sec-butyl, amyl, octyl, decyl, octadecyl, etc. When R is aralkyl, it may typically be benzyl, beta-phenylethyl, etc. When R is cycloalkyl, it may typically be cyclohexyl, cycloheptyl, cyclcoctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. When R is alkenyl, it may typically be vinyl, allyl, 1-butenyl, etc. R may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred R groups may be alkyl group having 6–20 carbon atoms including eg hexyls, octyls, decyls, etc. R may preferably be a $C_6$–$C_{15}$, more preferably a $C_{13}$ straight chain alkyl tridecyl.

R'' is a divalent hydrocarbon group which may be selected from the same group as that from which R is selected but having one less hydrogen atom. Preferably R'' is a $C_2$–$C_6$ group more preferably a $C_2$–$C_3$ group i.e. $—CH_2—CH_2—$ or $—CH_2—CH_2—CH_2$.

In the formula a is an integer 1–3. It will be apparent that when a is 3, the formula may be $(ROR'')_3N$ and the compositions may be tertiary amines typified by:

TABLE

| |
|---|
| $(C_{13}H_{27}O\ CH_2CH_2CH_2)_3\ N$ |
| $(C_{12}H_{25}O\ CH_2CH_2)_3\ N$ |
| $(C_{10}H_{21}O\ CH_2CH_2CH_2)_3\ N$ |

It will be apparent that when a is 2, the formula may be $(ROR'')_2\ NH$ and the compositions may be secondary amines typified by:

TABLE

| |
|---|
| $(C_{13}H_{27}O\ CH_2CH_2CH_2)_2\ NH$ |
| $(C_{12}H_{25}O\ CH_2CH_22)_2\ NH$ |
| $(C_{10}H_{21}O\ CH_2CH_2CH_2)_2\ NH$ |

It will be apparent that when a is 1, the formula will be that of the preferred amines, and the compositions may be primary amines typified by:

TABLE

| |
|---|
| tridecyl (oxypropyl) amine |
| $C_{13}H_{37}O\ CH_2CH_2CH_2—NH_2$ |
| $C_{12}H_{27}O\ CH_2CH_2—NH_2$ |
| $C_{10}H_{21}O\ CH_2CH_2CH_2—NH_2$ |

The preferred compositions may be the primary amines $R\text{-}O\text{-}R''\text{-}NH_2$ The compositions wherein R'' is $(—CH_2—)_3$ may be particularly preferred. A particularly preferred composition may be $C_{13}H_{27}O\ CH_2CH_2CH_2\text{-}NH_2$.

These compositions may be available commercially or they may be synthesized by reaction of an alcohol with an unsaturated nitrile to produce eg an alkoxyalkyl nitrile which may then be hydrogenated to the amine. An illustrative reaction may be that starting with acrylonitrile and the alcohol:

$$C_{13}H_{27}OH + CH_2{=}CH_2{-}C{\equiv}N \longrightarrow C_{13}H_{27}{-}O{-}CH_2CH_2C{\equiv}N$$

$$C_{13}H_{27}{-}O{-}CH_2CH_2C{\equiv}N + 2H_2 \xrightarrow[\text{catalyst}]{\text{Pton C}} C_{13}H_{27}{-}O{-}CH_2CH_2CH_2{-}NH_2$$

Illustrative commercially available compositions may be the following, the first listed being a preferred composition:

TABLE

| |
|---|
| A. The Armeen EA-13 brand of tridecyl (oxypropyl) amine |
| $C_{13}H_{27}—O—(CH_2)_3—NH_2$ |
| B. The Armeen EA-80 brand of a mixture containing |
| 5 w % $C_6H_{13}—O—(CH_2)_3—NH_2$ |
| 56 w % $C_8H_{17}—O—(CH_2)_3—NH_2$ |
| 39 w % $C_{10}H_{21}—O—(CH_2)_3—NH_2$ |
| C. The Armeen EA-25 brand of a mixture containing |
| 20 w % $C_{12}H_{25}—O—(CH_2)_3—NH_2$ |
| 30 w % $C_{13}H_{27}—O—(CH_2)_3—NH_2$ |
| 30 w % $C_{14}H_{29}—O—(CH_2)_3—NH_2$ |
| 20 w % $C_{20}H_{41}—O—(CH_2)_3—NH_2$ |

The so prepared rust and corrosion inhibitors may be added to an alkanol in minor corrosion-inhibiting amount of 0.25–25, preferably 1–20 PTB, more preferably 1–5 PTB, say 2 PTB. (PTB stands for pounds of additive per thousand barrels of alcohol or fuel). Alternatively expressed, the inhibitor may be added in an amount of 0.0001–0.01 w %, preferably 0.004–0.008 w %, more preferably 0.004–0.002 w %, say 0.0008 w %. Larger amounts may be employed, but may not be necessary.

It is a feature of this invention that the alcohol composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 10 ml of distilled water. The bottle is shaken the sample is maintained for 3 hours at 90° F. The percent rust on the strip is determined visually. A second reading is taken after 6 days and further readings may be taken.

The inhibited alcohols of this invention, after 40 hours of ISCT generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this Example of the best mode of practicing the invention, 7.68 ppm of Armeen EA-13 tridecyl (oxypropyl) amine (5 PTB) are added as additive to 90 parts of absolute alcohol drawn from a reservoir having the composition of Table I supra.

Distilled water (10 parts) is added and the system is subjected to the ISCT Test. The iron strip is observed after 6 days.

EXAMPLE II*

In this control example, the test procedure of Example I is duplicated except that the additive is 100 PTB of the Ethomid HT/15 brand of $$R{-}\overset{\overset{\displaystyle O}{\|}}{C}{-}N\ (CH_2CH_2O\ CH_2CH_2OH)_2$$

wherein R is an alkyl group derived from hydrogenated tallow in place of the additive of Example I.

EXAMPLE III*

In this control Example, no additive is present.

The results of the Iron Strip Corrosion Test were as follows:

TABLE

| Example | Six-Day Rust & Corrosion Rating |
|---|---|
| I | trace |
| II | 25%–30% |
| III | 30% |

From the above table, it will be apparent that the system of Example I, prepared in accordance with practice of this invention showed only a trace of rust and corrosion. Control Examples II–III showed 25%–30% rust and corrosion which is unsatisfactory.

Results comparable to those of Example I may be obtained when the additive or the alcohol is:

TABLE

| Example | Additive |
|---|---|
| IV | 5 PTB of Armeen EA-80 brand of additive set forth in the Table supra as Compound B |
| V | $(C_6\text{–}C_{10})\text{—O—}CH_2CH_2CH_2NH_2$ |
| VI | $(C_{12}\text{–}C_{15})\text{—O—}CH_2CH_2CH_2\text{—}NH_2$ |
| VII | $(C_8\text{–}C_{10})\text{—O—}CH_2CH_2CH_2\text{—}NH_2$ |

TABLE

| Example | Alcohol |
|---|---|
| VIII | Gasohol containing 90 v % gasoline and 10 v % absolute ethanol |
| IX | Absolute ethanol |
| X | Absolute methanol |

The additives of this invention permit attainment of desirable corrosion inhibition in alcohol systems in marked contrast to those falling outside the scope of the invention. Illustrative of such materials which do not function satisfactorily are the following:

TABLE

| Example | Additive |
|---|---|
| XI* | $R\text{—}\overset{\overset{\displaystyle O}{\|}}{C}\text{—}N(CH_2CH_2OCH_2CH_2NH_2)_2$ |
| XII* | $[R_2N(CH_3)_2]^+ \quad Cl^-$ |
| XIII* | $[RN(CH_3)_3]^+ \quad Cl^-$ |

Wherein in each of Control Examples XI*, XII*, and XIII*, R is $C_{12}$–$C_{18}$ derived from cocoyl.

Although this invention has been illustrated by reference to specific embodiments, it will be apparent to those skilled in the art that various changes and modifications may be made which clearly fall within the scope of this invention.

What is claimed is:

1. A composition comprising (i) a water-soluble alcohol; and (ii) an effective corrosion-inhibiting amount, as corrosion inhibiting additive, of an amine having the formula $$(R\text{-}O\text{-}R'')_a\text{-}NH_{3\text{-}a}$$

wherein R contains 6–30 carbon atoms and is selected from the group consisting of alkyl, alkenyl, alkaryl, aralkyl, cycloalkyl, and aryl groups and R″ is a divalent hydrocarbon group containing 1–30 carbon atoms and is selected from the group consisting of alkyl, alkenyl, alkaryl, aralkyl, cycloalkyl, and aryl groups, and a is an integer 1–3.

2. A composition as claimed in claim 1 wherein said water-soluble alcohol composition contains ethanol.

3. A composition as claimed in claim 1 wherein said water-soluble alcohol composition contains methanol.

4. A composition as claimed in claim 1 wherein said water-soluble alcohol composition contains anhydrous methanol or ethanol.

5. A composition as claimed in claim 1 wherein said water-soluble alcohol composition contains ethanol together with acidic contaminants.

6. A composition as claimed in claim 1 wherein said additive is:

$$ROR''\text{-}NH_2$$

7. A composition as claimed in claim 1 wherein said additive is $$ROR''\text{-}NH_2$$

wherein R is a $C_6$–$C_{15}$ alkyl.

8. A composition as claimed in claim 1 wherein said additive is $$ROR''\text{-}NH_2$$

wherein R″ is a $C_2$–$C_3$ straight chain alkyl.

9. A composition as claimed in claim 1 wherein said additive is $$ROR''\text{-}NH_2$$

wherein R is a $C_6$–$C_{15}$ straight chain alkyl and R″ is a $C_2$–$C_3$ straight chain alkyl.

10. A composition as claimed in claim 1 wherein said additive is $$C_{13}H_{27}O\ CH_2CH_2CH_2\text{-}NH_2$$

11. A composition as claimed in claim 1 wherein said additive is $$(ROR'')_3N$$

12. A composition as claimed in claim 1 wherein said additive is $$(ROR'')_3N$$

wherein R is a $C_6$–$C_{15}$ alkyl.

13. A composition as claimed in claim 1 wherein said additive is $$(ROR'')_3N$$

wherein R″ is a $C_2$–$C_3$ straight chain alkyl.

14. A composition as claimed in claim 1 wherein said additive is $$(ROR'')_3N$$

wherein R'' is $C_2$–$C_3$ straight chain alkyl and R is a $C_6$–$C_{15}$ alkyl.

15. A composition as claimed in claim 1 wherein said additive is $$(C_{13}H_{27}O\ CH_2CH_2CH_2)_3N$$

16. A composition as claimed in claim 1 wherein said additive is $$(ROR'')_2NH$$

17. A composition as claimed in claim in 1 wherein said additive is $$(ROR'')_2NH$$

wherein R is a $C_6$–$C_{15}$ alkyl.

18. A composition as claimed in claim 1 wherein said additive is $$(ROR'')_2NH$$

wherein R'' is a $C_2$–$C_3$ straight chain alkyl.

19. A composition as claimed in claim 1 wherein said additive is $$(ROR'')_2NH$$

wherein R is a $C_1$–$C_{15}$ straight chain alkyl and R'' is a $C_2$–$C_3$ straight chain alkyl.

20. A composition as claimed in claim 1 wherein said additive is $$(C_{13}H_{27}O\ CH_2CH_2CH_2)_2NH$$

21. A composition comprising (i) at least one of ethanol and methanol; and (ii) 0.25–25 PTB of $C_{13}H_{27}O\ CH_2CH_2CH_2\ NH_2$.

22. The method of inhibiting against corrosion a water-soluble alcohol composition which comprises adding to said water-soluble alcohol composition an amine having the formula $$(ROR'')_a\text{-}NH_{3-a}$$

wherein R contains 6–30 carbon atoms and is selected from the group consisting of alkyl, alkenyl, alkaryl, aralkyl, cycloalkyl, and aryl groups and R'' is a divalent hydrocarbon group containing 1–30 carbon atoms and is selected from the group consisting of alkyl, alkenyl, alkaryl, aralkyl, cycloalkyl, and aryl groups, and a is an integer 1–3.

* * * * *